US006249090B1

(12) United States Patent
Popov et al.

(10) Patent No.: US 6,249,090 B1
(45) Date of Patent: Jun. 19, 2001

(54) ELECTRODELESS FLUORESCENT LAMP WITH SPREAD INDUCTION COIL

(75) Inventors: Oleg Popov, Needham; Jakob Maya, Brookline, both of MA (US)

(73) Assignee: Matsushita Electric Works Research & Development Laboratories Inc, Woburn, MA (US)

( * ) Notice: Subject to any disclaimer, the term of this patent is extended or adjusted under 35 U.S.C. 154(b) by 0 days.

(21) Appl. No.: 08/674,783

(22) Filed: Jul. 3, 1996

(51) Int. Cl.[7] ..... H05B 41/16; H05B 41/24
(52) U.S. Cl. ..... 315/248; 315/344
(58) Field of Search ..... 315/248, 344

(56) References Cited

U.S. PATENT DOCUMENTS

| | | | |
|---|---|---|---|
| 2,030,957 | 2/1936 | Bethenod et al. | 176/122 |
| 4,010,400 | 3/1977 | Hollister | 315/248 |
| 4,568,859 | 2/1986 | Houkes et al. | 315/248 |
| 4,622,495 | 11/1986 | Smeelen | 315/248 |
| 4,704,562 | 11/1987 | Postma et al. | 315/248 |
| 4,710,678 | 12/1987 | Houkes et al. | 315/39 |
| 4,727,295 * | 2/1988 | Postma et al. | 315/248 |
| 5,325,018 | 6/1994 | El-Hamamsy | 315/85 |
| 5,343,126 | 8/1994 | Farrall et al. | 315/248 |
| 5,355,054 | 10/1994 | Van Lierop et al. | 315/112 |
| 5,412,280 | 5/1995 | Scott et al. | 313/573 |
| 5,412,288 | 5/1995 | Borowiec et al. | 315/248 |
| 5,412,289 | 5/1995 | Thomas et al. | 315/248 |
| 5,461,284 | 10/1995 | Roberts et al. | 315/57 |
| 5,465,028 | 11/1995 | Antonis et al. | 315/248 |

* cited by examiner

*Primary Examiner*—Michael B Shingleton

(57) ABSTRACT

An electrodeless inductively-coupled fluorescent lamp which operates at radio frequencies and contains an induction coil (1) which is inserted in a reentrant cavity (2) of the envelope (7) and is spread along the length of the reentrant cavity (2). The coil (1) is disposed within a cylinder (14) of thermally conductive metal. The use of the spread coil provides for reduction of starting and operation voltages of the lamp and results in lowering of the energy of ions bombarding the inner surface of the envelope (7) and the cavity (2) and therefore improves lamp maintenance and increases lamp life.

5 Claims, 4 Drawing Sheets

ELECTRODELESS FLUORESCENT LAMP WITH SPREAD INDUCTION COIL

BACKGROUND OF THE INVENTION

Electrodeless inductively-coupled fluorescent lamps (ICFL) have longer life than conventional fluorescent lamps that employ hot cathodes. The plasma which radiates visible and UV light is generated in the lamp by an azimuthal electric field, $E_{ind}$, induced in the envelope by an induction coil. The coil is a critical component in the operation and performance of such lamps. This invention is about a particular design aspect of such a coil.

DESCRIPTION OF THE PRIOR ART

In a typical ICFL, a spiral-shaped induction coil is positioned in a reentrant cavity of the lamp envelope and has an inductance, $L_{coil}$, of 1–3 $\mu$H. In a U.S. patent application Ser. No. 08/538,239, by Popov et al. (owned by the same assignee as the present application), the induction coil had a squeezed shape and a value of $L_{coil}$=1.5–3 $\mu$H. By squeezed shape, we mean there were no separations between the turns of the coil. In the application of Popov et al., the squeezed coil is inserted in an aluminum cylinder which removes heat generated by the plasma from the coil and the cavity walls. The bulbous envelope has a spherical shape and is filled with the mixture of rare gas (Ar, Kr) and mercury vapor. The mercury vapor pressure is controlled by temperature of an amalgam positioned in a tubulation. The coil is connected to a matching network located in the lamp base. Radio frequency (RF) power is delivered to the lamp from an RF driver via an RF cable.

The introduction of the cylinder necessitates the use of a smaller coil diameter, $D_{coil}$, and, hence, a weaker coupling between the coil and the plasma, $K \approx D^2_{coil}/D^2_{pl}$, where K is the coupling coefficient and $D_{pl}$, is the diameter of the plasma. The diameter of the plasma, $D_{pl}$, is twice the radius, of the plasma ($2R_{pl}$). The plasma radius, $r_{pl}$, is determined as the distance from the lamp axis to the point where the plasma current density, $J_{pl}$, has the maximum value.

It is known a weaker coupling between the coil and the plasma results in higher coil RF current, thereby producing greater RF power losses in the coil. Consequently, a higher coil RF voltage is required for the transition from the capacitive discharge to the inductive discharge, $V_{tr}$. At low ambient temperatures, $T_{amb}$<0° C., the transition voltage is the highest coil RF voltage. The transition voltage is considered as a lamp starting voltage, $V_{st}$. It is desirable to have $V_{st}$ as low as possible from the RF lamp driver point of view.

Moreover, as a result of lower coupling coefficient, K, the coil RF voltage needed to maintain the inductive RF discharge at normal operation (maintaining voltage, $V_m$, at an RF power of about 40–100 W) is also higher. It is desirable from a lamp maintenance point of view for the lamp to have a low $V_m$. The lower the maintaining voltage, the lower the energy of ions bombarding the cavity walls whereby less damage is done to phosphor coating on the cavity walls. This substantially improves the lamp maintenance and extends the life of the lamp.

SUMMARY OF THE INVENTION

It is known the plasma density and its spatial distribution in the inductively-coupled plasma depends on the coil dimensions. When the diameter of the coil, $D_{coil}$, is smaller than the coil height, $H_{coil}$, the plasma has a toroidal shape. As the ratio of $H_{coil}/D_{coil}$ increases, the plasma changes its shape from toroidal to cylindrical. It is known from transformer theory that the coupling is better (higher K) when both primary (coil) and secondary (plasma) are cylinders than when the primary is cylindrical and the secondary is toroidal.

The increase of the ratio $H_{coil}/D_{coil}$ can be achieved by an increase in the number of turns, i.e., by an increase of the coil inductance. We have found, however, the increase of the coil inductance causes an increase of the lamp transition voltage and lamp maintaining voltage.

We have found the reduction of the $V_{tr}$ and $V_m$ can be achieved by spreading the coil along its axis. Having the same inductance as the squeezed coil, the spread coil has a higher ratio $H_{coil}/D_{coil}$ and, hence, better coupling with the plasma leading to a smaller transition voltage, V., and a smaller maintaining voltage, $V_m$. The higher the ratio $H_{coil}/D_{coil}$, the lower is the transition and maintaining voltage, and the longer is the lamp life.

As shown above, the coupling efficiency of the spread coil, K, is higher than that of the squeezed coil. On the other hand, the spread coil has larger coil resistance, $R_{coil}$, than that of the squeezed coil of the same inductance due to the longer length of the wire.

However, the RF current in the spread coil, $I_c$, is also lower, so the amount of RF power "consumed" by each coil, $P_c=I^2_cR_{coil}$, is the same, and the amount of RF power transferred into the plasma by the spread coil is equal (or close) to the power transferred to the plasma by the squeezed coil.

An object of the present invention is to provide an electrodeless inductively-coupled fluorescent light source which can be substituted for the incandescent light source, high pressure mercury light source, metal halide light source, or a compact fluorescent light source.

Another object of the present invention is to reduce the electrodeless lamp starting voltage.

A further object of the present invention is to reduce the lamp maintaining voltage thereby reducing the energy of ions bombarding the cavity walls and, therefore, improving the lamp maintenance.

Another object of the present invention is to reduce the RF coil current thereby reducing the RF losses in the coil and, hence, increasing the RF lamp efficiency.

An additional object of the present invention is to provide an RF electrodeless lamp which incorporates a Faraday shield, a spread induction coil and a matching network in the lamp base.

DESCRIPTION OF THE PREFERRED EMBODIMENT

Figure 1:
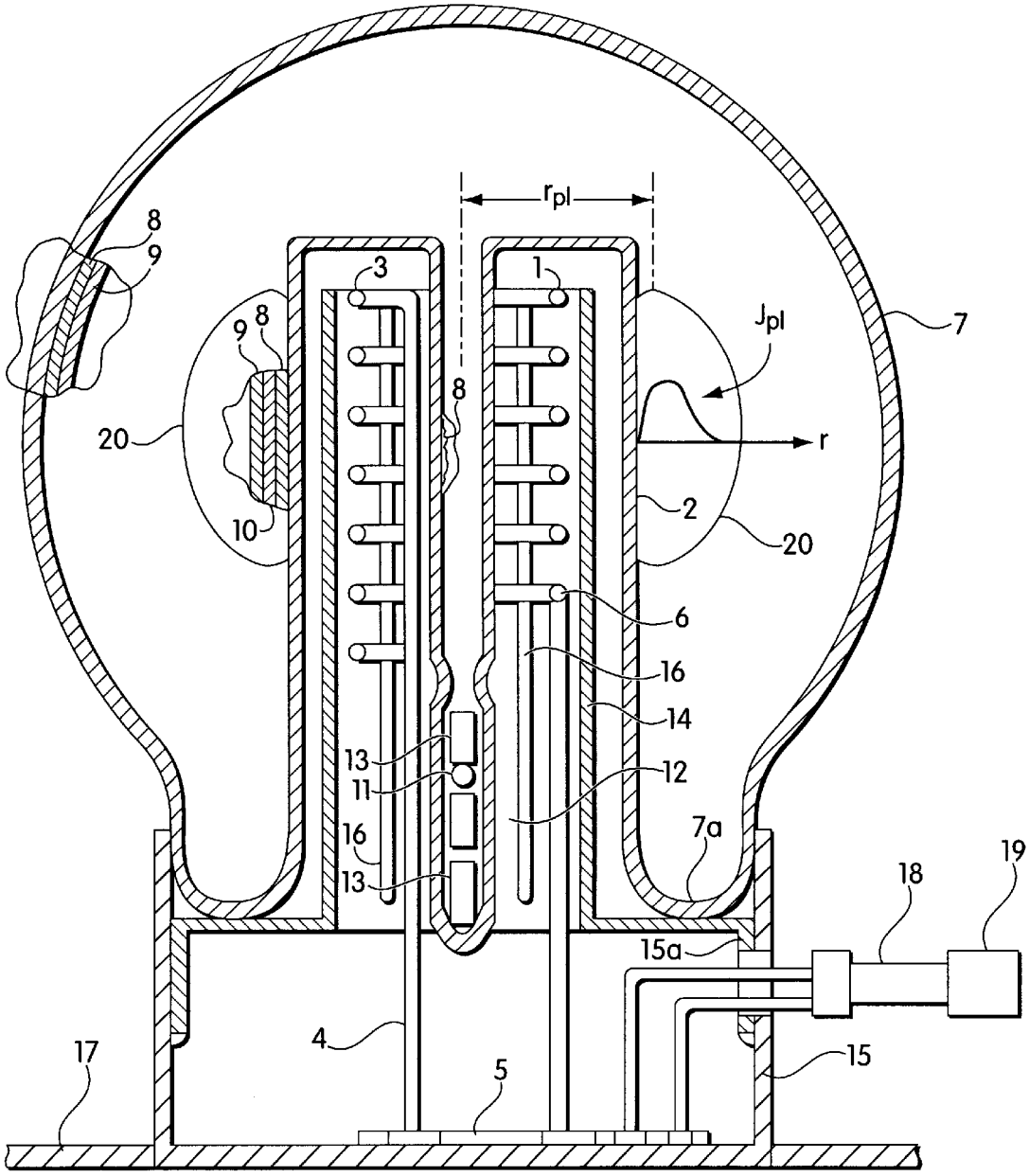
FIG. 1 shows a preferred embodiment of the present invention where an induction coil having turns which are equidistant from each other is used.

Referring now to FIG. 1, a bulbous envelope 7 is shown with a coating 9 of a conventional phosphor. A protective coating 8 formed of silica or alumina, or the like, is disposed beneath the phosphor coating 9. The envelope 7 contains a suitable ionizable gaseous fill, for example, a mixture of a rare gas (e.g., krypton and/or argon) and a vaporizable metal such as mercury, sodium and/or cadmium. Upon ionization of the gaseous fill, as will be explained hereinafter, the phosphor 9 is stimulated to emit visible radiation upon absorption of ultraviolet radiation. The envelope 7 has a bottom 7*a* disposed within a cylindrical base 15. The envelope 7 has a reentrant cavity 2 disposed in the bottom 7*a*. The protective coating 8 is also disposed on the inner wall of the cavity 2, as is a reflective coating 10. A coil 1 is disposed within a cylinder 14. Cylinder 14 is made of a light, conductive material having high thermal conductivity (Al or Cu, for example). The cylinder 14 is fitted in the reentrant cavity 2 between the coil 1 and the cavity walls. An exhaust tubulation 12 depends from the cavity 2. The cavity 2 extends along the axis of coil 1. The protective coating 8 mentioned above is also disposed within the tubulation 12. A drop of mercury amalgam 11 is disposed within exhaust tubulation 12 and held between glass supports 13 that are retained in place by a crimp in the tubulation.

The cylinder 14 is attached to a cylindrical flange 15*a*, preferably by welding. Such attachment reduces capacitive coupling between the coil 1 and the plasma 20 since the cylinder 14 is electrically connected to the grounded fixture 17 via the cylindrical flange 15*a* and a support frame 15. Support frame 15 and flange 15*a* form the base of the lamp. The bottom 7*a* of the envelope rests upon the support frame 15. Cylinder 14 conducts heat from plasma 20 in the envelope 7 through the flange 15*a* and support frame 15 to fixture 17 for dissipation.

Figure 2A:
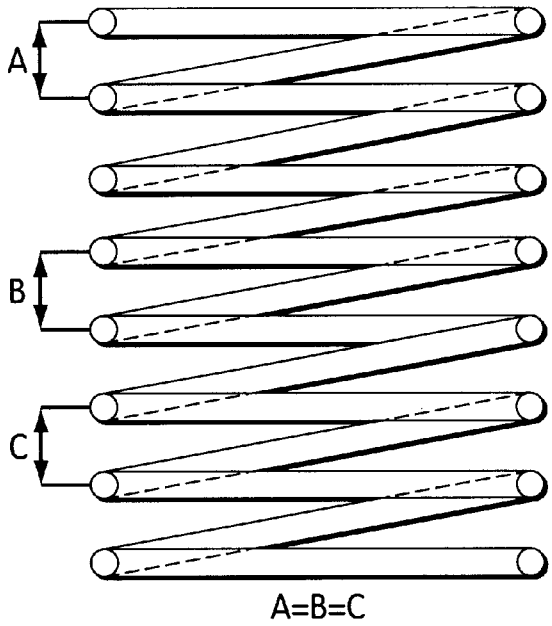
FIGS. 2A to 2D are schematic drawings of the spread coils of various configurations and coil pitches.
Figure 2B:
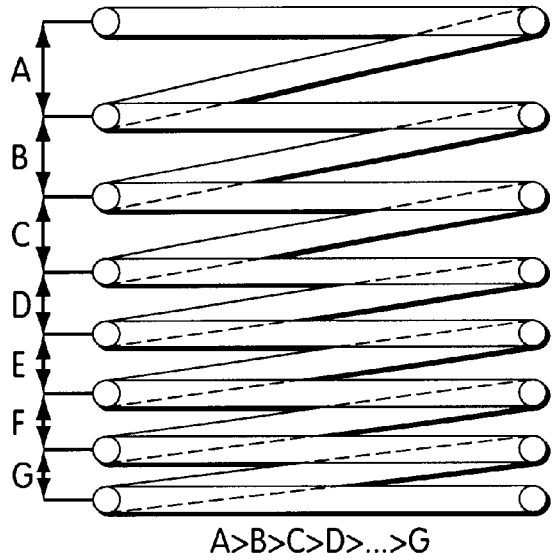
Figure 2C:
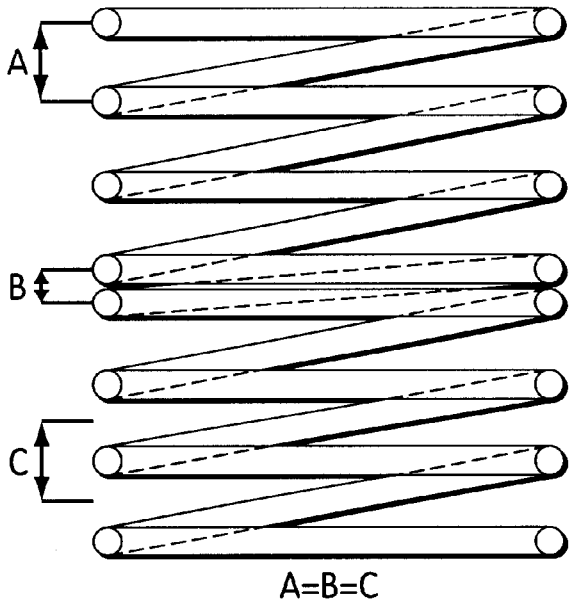
Figure 2D:
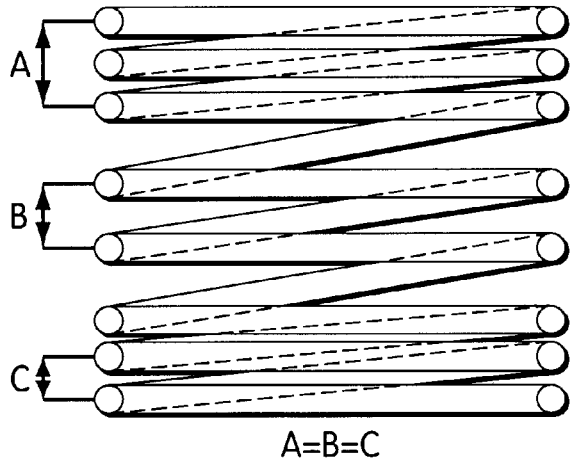

Various types of spread coils are shown in FIGS. 2A to 2D. We inserted each configuration in an ICFL and tested the lumen output of each lamp, its starting (transition) voltage and current. We found that each coil gives approximately the same lumen output and starting and maintaining voltage values provided the coil inductance, length, and diameter are the same. From the manufacturing point of view we chose the coil with the equidistant turns (FIG. 2A). A preferred embodiment of the present invention is shown in FIG. 1.

From the low starting voltage point of view it is desirable to use a coil 1 with large length and, hence, with the large pitch (distance between adjacent turns). However, with the required coil inductance of 1.7–2.2 $\mu$H, which is optimum from the light output point of view, and with a reentrant cavity 2 diameter of about 40 mm and height of about 80 mm, the coil height should not be longer than 45–50 mm. It was also found that the maximum lumen output is attained when the coil is positioned in the center of the envelope. Since the coil wire diameter is 2 mm and the number of turns, n, is between 7 and 11, the maximum pitch should be 5–6 mm. The top end 3 of the induction coil 1 is connected via the lead 4 to a conventional matching network 5. The bottom end 6 of the coil 1 is grounded. The coil 1 is inserted in the reentrant cavity 2 which is protruded in the envelope 7. The RF power is delivered to the lamp from an RF driver 19 via a coaxial cable 18.

As mentioned above, the inner surface of the envelope wall is coated with a protective coating 8 and phosphor coating 9, while the inner surface of the cavity walls are coated with the protective coating 8, reflective coating 10, and phosphor layer 9. The coil RF current generates the magnetic field which in turn induces in the envelope volume an azimuthal electric field Em which maintains the inductively-coupled RF discharge. In the preferred embodiment, the RF plasma is ignited in a mixture of rare gas (0.1–1 torr) and mercury vapor. The mercury pressure is controlled by the temperature of the amalgam 11 placed in the tubulation 12. The position of amalgam is chosen to provide fast lamp run-up time at low ambient temperature and maintain the high light output within the wide range of ambient temperatures as it was described in U.S. patent application Ser. No. 08/559,557, by Maya et al. Glass-made pieces 13 help to hold the amalgam 11 in a fixed position.

In the preferred embodiment we used RF voltage at a frequency of f=13.56 MHz, though a higher or lower RF frequency could be used. We ignited RF electrodeless lamps at ambient temperatures from −20° C. to +70° C. At low ambient temperatures, when the partial pressure of mercury vapor is very low, the ignition of the capacitive discharge is controlled only by the rare gas pressure. At rare gas pressures sures of 0.1–0.5 torr, the capacitive discharge is ignited at around $V_{cap}$=400–500 V. As RF voltage increases, the RF power absorbed by the lamp and the coil current increases also.

As RF current increases, the azimuthal electric field, $E_{ind}$, increases too. When $E_{ind}$ reaches a value which is high enough to sustain inductively-coupled discharge, the plasma conductivity drastically increases which leads to the sharp increase of the plasma luminosity. This increase is accompanied with the drop in the value of RF voltage across the coil and the coil current. Those coil RF voltage and current are called the transition voltage (transition from the capacitive discharge to the inductive discharge), $V_{tr}$, and transition current, $I_{tr}$. The typical RF power at which the transition occurs is $P_{tr}$=4–7 W. As RF power becomes higher than $P_{tr}$, both $V_{coil}$ and $I_{coil}$ decrease. Beginning from 20–25 W, $V_{coil}$ and $I_{coil}$ start increasing.

Figure 3A:
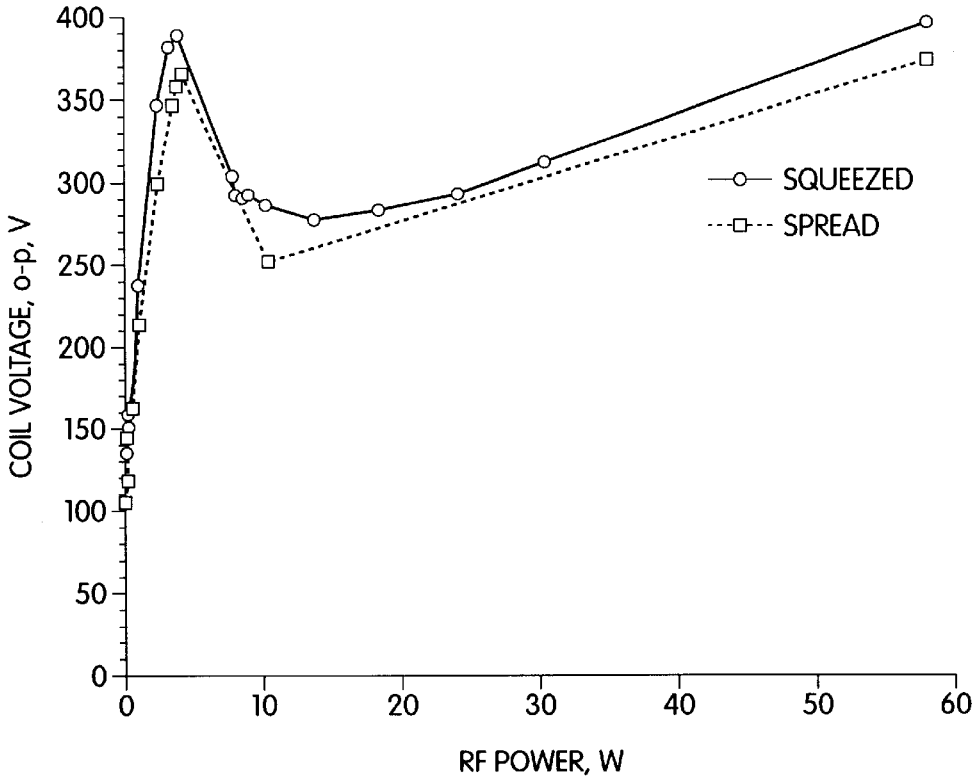
FIGS. 3A and 3B are curves illustrating induction coil maintaining voltages and currents as a function of RF power for the ICFL using a squeezed coil and a spread coil of the present invention.
Figure 3B:
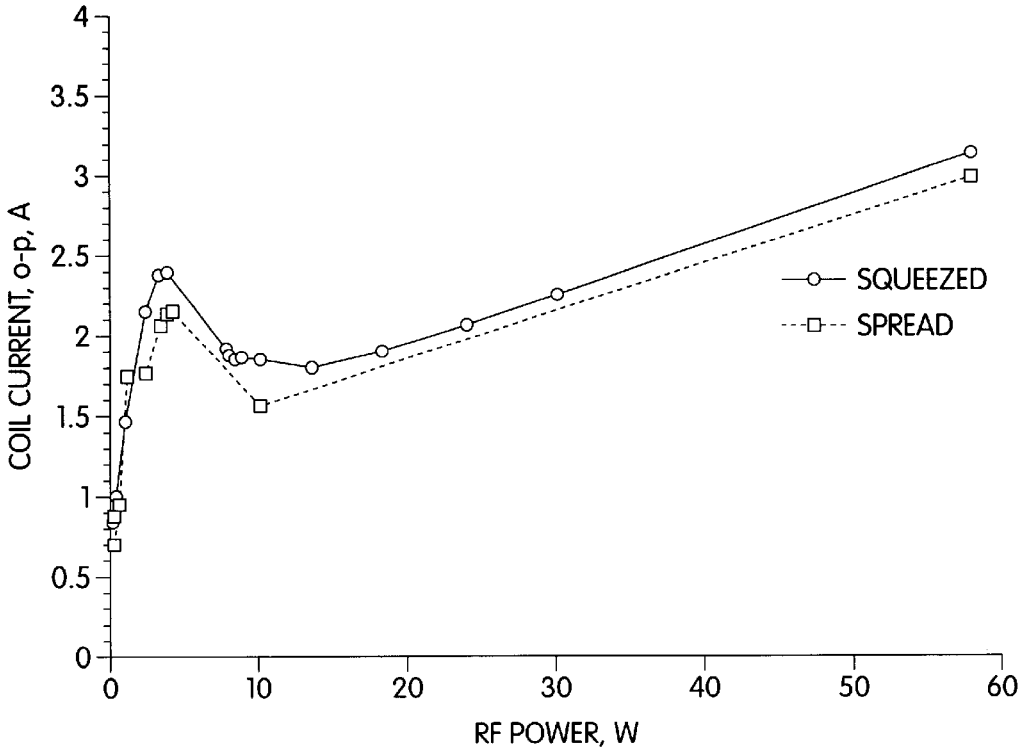

The typical dependencies of $V_{coil}$ and $I_{coil}$ on RF power are shown in FIGS. 3A, B, for squeezed and spread coils measured at room temperature. It can be seen that the voltage across the spread coil is smaller than that across the squeezed coil within the whole range of RF power from the ignition of the capacitive discharge up to high RF power of 60 W. This means that the RF voltage across the spread coil during operation at 30–60 W (maintaining voltage, $V_m$) is lower than that in the lamp using the squeezed coil. Lower $V_m$ contributes to better maintenance of lamps, as discussed above. The current in the spread coil is slightly lower than that in the squeezed coil. Since the active resistance of the spread coil of the same inductance is slightly higher, the reduction in the coil current results in the same RF power losses in the spread and squeezed coils.

The results of the measurements of the transition voltage of krypton-filled lamps using spread and squeezed coils are shown for the ambient temperature of −20° C. in the following Table 1. One can see that each lamp which uses the spread coil has 20–30 V lower transition voltage than the same lamp when it uses the squeezed coil.

TABLE 1

TRANSITION VOLTAGES IN SQUEEZED AND SPREAD COILS
KRYPTON, 0.3 TORR
$T_{amb}$ = −20° C.
$L_{coil}$ = 1.7 $\mu$H

| Lamp # | $V_{tr}$, V SQUEEZED COIL | $V_{tr}$, V SPREAD COIL |
|---|---|---|
| 249 | 462 | 437 |
| 250 | 480 | 462 |
| 257 | 475 | 444 |
| 264 | 469 | 450 |
| 269 | 487 | 462 |

It is apparent that modifications and changes can be made within the spirit and scope of the present invention, but it is our intention only to be limited by the scope of the following claims.

As our invention we claim:

1. An electrodeless fluorescent RF lamp and fixture comprising:

a bulbous lamp envelope and a reentrant cavity disposed in said envelope, a rare gas and vaporizable metal fill in said envelope and a phosphor coating on the interior thereof for generation of visible light;

a lamp base disposed outside said envelope and said fixture being attached to said lamp base;

a cylinder formed of a light thermally-conductive metal disposed in said reentrant cavity, said cylinder being attached to said lamp base;

an induction coil and radio frequency excitation generating means associated with said coil for the generation of a plasma to produce radiation to excite said phosphor coating, said coil and said means being situated outside said envelope and fitted within said cavity and within said cylinder, at least a major portion of said coil having a pitch between about 1 and 10 mm and a wire diameter between about 0.5 and 3.0 mm, said coil having a top portion, a bottom portion and a middle portion, the pitch of the turns of said coil in said top and bottom portions being less than the pitch of the turns in said middle portion.

2. The lamp according to claim 1 wherein said coil generates a substantially cylindrical plasma in said envelope whereby to increase the ratio of $H_{coil}/D_{coil}$ whereby to improve coupling between the coil and plasma and reduce starting and maintenance voltages to enhance lamp maintenance.

3. The lamp according to claim 1 wherein the ratio of $H_{coil}/D_{coil}$ is between about 0.5 and 5 thereby generating a generally cylindrical plasma to improve coupling between the cylindrical coil and cylindrical plasma.

4. The lamp according to claim 1 wherein the coil turns are spaced from each other such as to provide a coil inductance of 1.5–2.5 $\mu$H.

5. The lamp according to claim 1 further including means disposed in said cavity to remove heat generated by said plasma from said cavity and said coil, said means further suppressing capacitive coupling between said coil and said plasma whereby to reduce ion bombardment of the phosphor coating on the inner surface of said cavity thereby improving maintenance of said lamp.

* * * * *